US006880630B2

(12) United States Patent
Widney

(10) Patent No.: US 6,880,630 B2
(45) Date of Patent: Apr. 19, 2005

(54) GUIDE SUPPORT FOR RIG MOUNTED CONTINUOUS FEED INJECTION UNIT

(75) Inventor: Mark D. Widney, Ardrossan (CA)

(73) Assignee: C-Tech Energy Services, Inc. (CA)

( * ) Notice: Subject to any disclaimer, the term of this patent is extended or adjusted under 35 U.S.C. 154(b) by 99 days.

(21) Appl. No.: 10/329,327

(22) Filed: Dec. 23, 2002

(65) Prior Publication Data

US 2004/0118556 A1 Jun. 24, 2004

(51) Int. Cl.[7] ..... E21B 19/22
(52) U.S. Cl. ..... 166/77.53; 166/85.5
(58) Field of Search ..... 166/77.2, 77.3, 166/85.5; 242/397.1, 566, 615, 615.1

(56) References Cited

U.S. PATENT DOCUMENTS

| | | | | |
|---|---|---|---|---|
| RE25,680 E | | 11/1964 | Brown | 254/29 R |
| 3,215,203 A | | 11/1965 | Sizer | 166/77 |
| 3,285,485 A | | 11/1966 | Slator | 226/172 |
| 3,313,346 A | | 4/1967 | Cross | 166/5 |
| 3,373,818 A | | 3/1968 | Rike et al. | |
| 3,559,905 A | | 2/1971 | Palynchuk | 242/54 |
| 3,926,260 A | | 12/1975 | Slator | 166/315 |
| 4,169,296 A | * | 10/1979 | Wipkink et al. | 14/71.1 |
| 4,615,063 A | * | 10/1986 | Rolen | 14/18 |
| 4,673,035 A | | 6/1987 | Gipson | 166/77 |
| 5,348,097 A | | 9/1994 | Giannesini | 166/385 |
| 5,553,668 A | | 9/1996 | Council et al. | 166/77.3 |
| 5,842,530 A | | 12/1998 | Smith et al. | |
| 5,890,534 A | | 4/1999 | Burge et al. | 166/77.3 |
| 5,992,516 A | | 11/1999 | Palynchuk et al. | 166/77.2 |
| 6,006,839 A | * | 12/1999 | Dearing et al. | 166/384 |
| 6,279,363 B1 | | 8/2001 | Averbuch et al. | 72/8.3 |
| 6,332,501 B1 | | 12/2001 | Gipson | |
| 6,575,241 B1 | | 6/2003 | Widney et al. | 166/242.2 |
| 2004/0020658 A1 | * | 2/2004 | Kulhanek et al. | 166/377 |

FOREIGN PATENT DOCUMENTS

| | | | |
|---|---|---|---|
| CA | 953644 | 8/1974 | 166/521 |
| CA | 1220418 | 4/1987 | 166/53 |
| CA | 2217413 | 10/1997 | |
| CA | 2299765 | 2/2000 | |

OTHER PUBLICATIONS

Sperry Vickers, "Mobile Hydraulics Manual M–2990–A" First Edition 1967; Second Edition 1979.
Industrial Fluid Power, vol. 3, Second Edition Published By Womack Educational Publications.
Robinshaw Engineering Inc. Of Houston, Texas Drawing.
Design Engineers Handbook; Bulletin 0224–B1.

* cited by examiner

*Primary Examiner*—William Neuder
(74) *Attorney, Agent, or Firm*—Frank J. Dykas; Dykas, Shaver & Nipper

(57) ABSTRACT

A continuous well string injection system, comprising a rig, such as a drilling or service rig, a continuous feed injection unit suspended from the rig, a continuous well string guide forming a conduit for continuous well string between a continuous well string holder and the continuous feed injection unit, the continuous well string guide being suspended from the rig at a suspension point between the continuous feed injection unit and the continuous well string holder; and a tension device, such as a cable, straddling the suspension point to restrain lateral movement of the continuous well string injection unit in relation to the continuous well string holder.

6 Claims, 1 Drawing Sheet

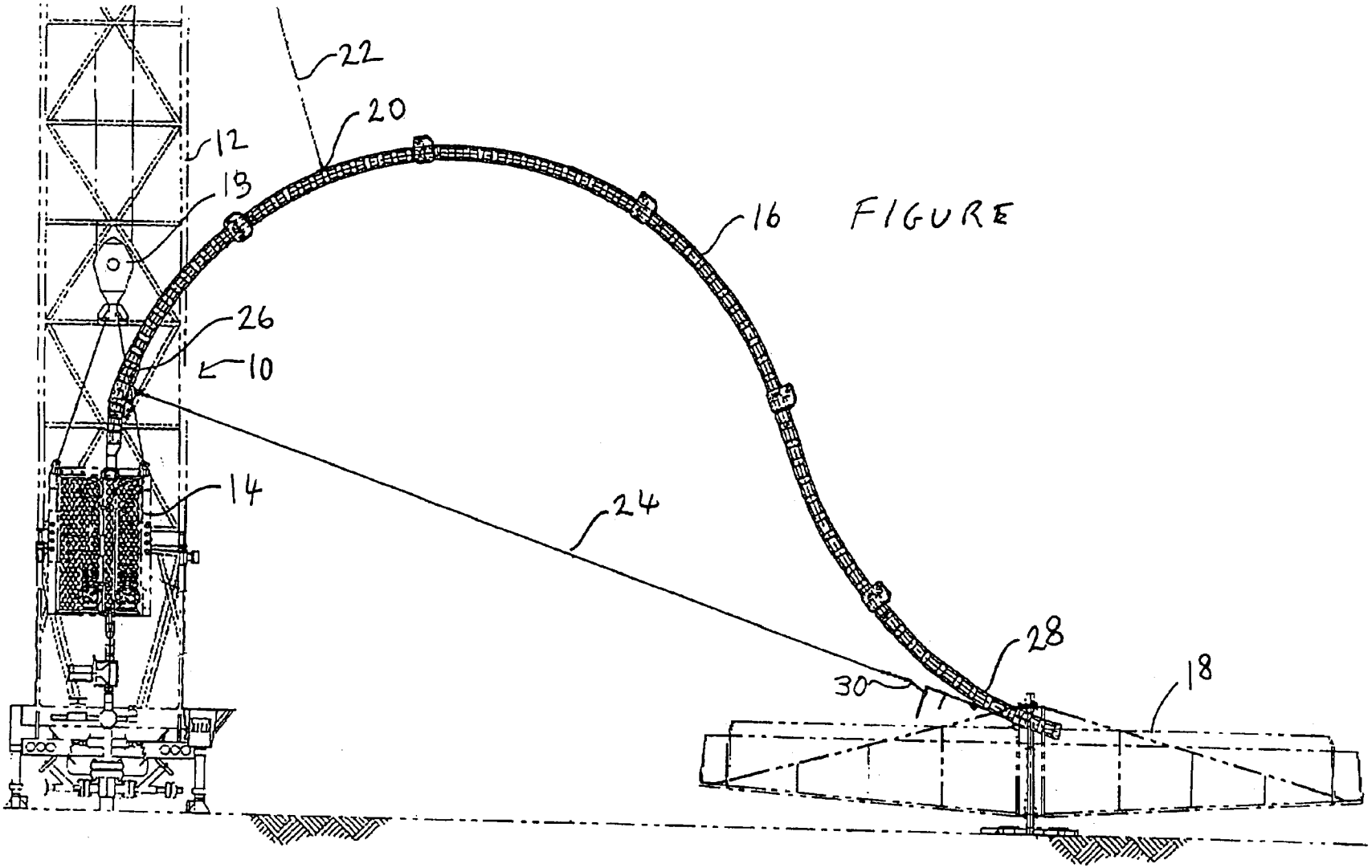
FIGURE
10
12
14
16
18
19
20
22
24
26
28
30

GUIDE SUPPORT FOR RIG MOUNTED CONTINUOUS FEED INJECTION UNIT

BACKGROUND OF THE INVENTION

This invention relates to devices used to manipulate continuous well strings for wellsite operations. Continuous well strings include rod, used for example to operate downhole pumps, and continuous tubing, used for example in a variety of downhole applications such as drilling and clean out operations. Continuous well strings are manipulated downhole typically with continuous feed injection units that include gripper pads for gripping the well strings. One early such design is shown in U.S. Pat. No. 3,559,905 of Palynchuk, issued Feb. 1, 1971, in which a continuous chain with gripping blocks carried by the chain is used to inject the well string into the well. More recently, such continuous chain gripper systems have been described in U.S. Pat. No. 5,553,668 of Council, et al, issued Sep. 10, 1996.

As disclosed in Canadian patent application no. 2,351,648 published Feb. 21, 2002 the continuous feed injection units are suspended from the travelling block of a rig, such as a drilling rig or service rig. A continuous well string is fed through a guide from a carousel into the continuous feed injection unit. The guide is itself suspended from the rig. The tendency of the guide to straighten results in lateral stresses on the continuous feed injection unit. This invention is directed towards a method of reducing lateral stresses on the continuous feed injection unit.

SUMMARY OF THE INVENTION

Therefore there is provided a continuous well string injection system in which a rig, such as a drilling or service rig, has a continuous feed injection unit suspended from the rig. A continuous well string guide forms a conduit for continuous well string between a continuous well string holder and the continuous feed injection unit. The continuous well string guide is suspended from the rig at a suspension point between the continuous feed injection unit and the continuous well string holder. A tension device, such as a cable, straddles the suspension point to restrain lateral movement of the continuous well string injection unit in relation to the continuous well string holder.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which the FIGURE shows a side view of a drilling rig with a continuous feed injection unit according to the invention.

DETAILED DESCRIPTION OF PREFERRED EMBODIMENTS

In this patent document, "comprising" means "including". In addition, a reference to an element by the indefinite article "a" does not exclude the possibility that more than one of the element is present.

Referring to the FIGURE, there is shown a rig 10 such as a drilling rig or service rig with a conventional mast 12 and travelling block 13 from which is suspended a continuous feed injection unit 14. The continuous feed injection unit 14 may be conventional or may be a unit such as the X-celerator™ of C-Tech Energy Services Inc. of Edmonton, Alberta, Canada. A guide 16 forms a conduit for continuous well string (not shown) from a conventional carousel or continuous well string holder 18 to the continuous well string injection unit 14. The guide 16 is a conventional guide for providing a conduit for continuous well string such as coiled tubing or rod to a well and is made of connected hollow links that may pivot with respect to each other so that the guide 16 in use may flex to form an arc through which the continuous well string is guided. The guide 16 is suspended from the rig 10 at a suspension point 20 between the continuous feed injection unit 14 and the carousel 18. A cable 22 may be used to suspend the guide 16 from the rig 10. The suspension point 20 is chosen so that the cable 22 is perpendicular to a tangent to the guide 16 at the suspension point 20.

To reduce lateral forces on the continuous feed injection unit 14 due to the guide 16, a tension device 24, such as a cable, straddles the suspension point 20 to prevent lateral motion of the continuous well string injection unit 14 in relation to the carousel 18. For most effective use, the tension device 24 is connected at a first section 26 of the continuous well string guide 16 at the continuous well string injection unit 14 and a second section 28 of the continuous well string guide 16 at the carousel 18, with the suspension point being located between the first section and the second section. The tension device 24 could also be connected directly between the continuous feed injection unit 14 and the carousel 18, or even some other fixed object such as the ground.

The tension device 24 is preferably connected at the first hinge point in the guide 16 above the continuous well string injection unit 14, which in a typical unit is about 3 feet above the continuous well string injection unit 14. Tension on the tension device 24 may be created in any suitable fashion, as for example by incorporating a chain boomer or load binder 30 on the tension device 24. The tension in the tension device 24 is adjusted so that there are no lateral stresses tending to move the continuous well string injection unit sideways and continuous well string injection unit 14 is located directly below the travelling block 13. The chain boomer 30 may be of the type typically used to tighten chains used to secure a load on a vehicle. The connection points of the tension device to the guide may be made in any suitable manner.

Immaterial modifications may be made to the invention described here without departing from the invention.

I claim:

1. A continuous well string injection system, comprising:

a rig;

a continuous injection unit suspended from the rig;

a continuous well string guide forming a conduit for continuous well string between a continuous well string holder and the continuous feed injection unit;

the continuous well string guide being suspended from the rig at a suspension point between the continuous feed injection unit and the continuous well string holder; and a tension device straddling the suspension point to restrain lateral movement of the continuous well string injection unit in relation to the continuous well string holder.

2. The continuous well string injection system of claim 1 in which tension device is connected between a first section of the continuous well string guide and a second section of the continuous well string guide with the suspension point being located between the first section and the second section.

3. The continuous well string injection system of claim 2 in which the first section is located at the continuous well string injection unit.

4. The continuous well string injection system of claim 3 in which the second section is located at the continuous well string holder.

5. The continuous well string injection system of claim 4 in which the rig is a drilling rig.

6. The continuous well string injection system of claim 5 in which the tension device is a cable.

* * * * *